US005943854A

United States Patent [19]

Schuller et al.

[11] Patent Number: 5,943,854

[45] Date of Patent: Aug. 31, 1999

[54] OPENING ROLLS FOR AN OPEN END SPINNING APPARATUS

[75] Inventors: Edmund Schuller, Ingolstadt; Josef Schermer, Berheim; Eva-Maria Greppmair, Gachenbach; Werner Strasser, Steckborn, all of Germany

[73] Assignee: Rieter Ingolstadt Spinnereimaschinenbau AG, Ingolstadt, Germany

[21] Appl. No.: 08/994,815

[22] Filed: Dec. 19, 1997

[30] Foreign Application Priority Data

Dec. 20, 1996 [DE] Germany ..... 196 53 359

[51] Int. Cl.[6] ..... D01H 4/00

[52] U.S. Cl. ..... 57/408; 19/100; 19/112; 19/114

[58] Field of Search ..... 57/406, 408; 19/97, 19/100, 112, 114

[56] References Cited

U.S. PATENT DOCUMENTS

| | | | |
|---|---|---|---|
| Re. 32,507 | 9/1987 | Schmid et al. . | |
| Re. 33,190 | 4/1990 | Stahlecker . | |
| 2,849,844 | 9/1958 | Snape, Jr. . | |
| 3,264,690 | 8/1966 | Morrill . | |
| 3,800,520 | 4/1974 | Schiltknecht . | |
| 4,067,625 | 1/1978 | Goldammer . | |
| 4,163,304 | 8/1979 | Laflaquiere et al. . | |
| 4,196,496 | 4/1980 | Stauffer et al. . | |
| 4,208,767 | 6/1980 | Schmolke . | |
| 4,296,527 | 10/1981 | Eadie . | |
| 4,300,265 | 11/1981 | Heinen . | |
| 4,352,224 | 10/1982 | Grimshaw et al. . | |
| 4,435,953 | 3/1984 | Schmid et al. . | |
| 4,679,390 | 7/1987 | Stewart . | |
| 4,715,177 | 12/1987 | Stahlecker | 57/408 |
| 4,805,395 | 2/1989 | Stahlecker et al. . | |
| 4,858,275 | 8/1989 | Stahlecker et al. . | |
| 4,894,983 | 1/1990 | Schmid | 19/97 |
| 5,085,047 | 2/1992 | Hofmann . | |
| 5,497,610 | 3/1996 | Rottmayr . | |
| 5,709,074 | 1/1998 | Stahlecker | 57/408 |
| 5,794,311 | 8/1998 | Schuller et al. | 57/408 |

FOREIGN PATENT DOCUMENTS

| | | | |
|---|---|---|---|
| 0436754A1 | 7/1991 | European Pat. Off. . | |
| 0450266A1 | 10/1991 | European Pat. Off. . | |
| 2752891 | 5/1979 | Germany | 19/97 |
| 3730296A1 | 3/1989 | Germany . | |
| 4039634A1 | 6/1992 | Germany . | |
| 3730295A1 | 3/1998 | Germany . | |
| 661535 | 7/1987 | Switzerland . | |

OTHER PUBLICATIONS

German Patent Office Search Report, Apr. 18, 1997.

*Primary Examiner*—William Stryjewski
*Attorney, Agent, or Firm*—Dority & Manning

[57] ABSTRACT

A multicomponent opening roll for an open end spinning apparatus includes a core piece, upon which a holder for a tooth-set carrier is fastened. The tooth-set carrier (12) must be exchangeable as is determined by operational wear. In order that the axial width of the opening roll (1) is made independent of the axial width of the tooth-set carrier (12), the core piece (11) possess an axial detent (131) for the holder (13).

20 Claims, 4 Drawing Sheets

OPENING ROLLS FOR AN OPEN END SPINNING APPARATUS

BACKGROUND OF THE INVENTION

The invention concerns an opening or separating roll for an open end spinning apparatus. From the current state of technology, opening rolls for open end spinning apparatuses are common knowledge, which, for the purpose of replacement of the tooth-set, are built in multicomponent fashion. The set can be comprised of teeth or needles, which are installed on a tooth-set carrier. The said carrier is designed in the shape of a cylindrical ring, which is installed on a core piece of the opening roll and is held by a holder on said core piece.

During the operation of the open end spinning apparatus, the opening roll rotates in an opening roll housing. In this housing, bunched fibers are introduced and the individual fibers which are opened or separated out are removed through a fiber feed duct. For the function of the open end spinning apparatus, the condition of the air in the opening roll housing plays a decisive role. For this purpose, it is necessary that the opening between the opening roll and the housing is held very precisely to a specified value. The relationships within the separating roll must not be changed by means of the regularly required exchange of the toothed set, which, as is known, is subject to wear.

The patent DE-A 25 28 485 shows an opening roll in which the ring shaped tooth-set carrier is secured by force locking by a flexible element in connection with a holder for the tooth-set carrier on the core piece. The flexible element, by being subjected to a force in a radial direction, moves so that it impacts against the ring shaped tooth-set carrier from within and affixes this against the opening roll. In this way, the holder forms, at least partly, the front side of the opening roll. The width of the opening roll is thereby adjusted in such a way that the holder is made controllable as to axial direction. This is accomplished, for instance, through a threading on the core piece to which the holder itself is directly screwed, or is held by fastening means, such as screws.

The flexible element enables that the holder, even after the contact with the flexible element, still remains axially adjustable up to the desired width of the opening roll. The determination of the opening roll width is redone from start as a new operation by measurement and adjustment of the insertion depth of the holder each time there is a change in the tooth-set by the maintenance person. Subsequently, the holder, so that it will not on its own change position, must be secured by a safety element on the core piece of the opening roll. The adjustment of the width of the opening roll can, indeed, be carried out very precisely by the method taught in the patent DE-A 25 28 485, wherein the width is independent of the axial extension of the tooth-set carrier. The adjustment of the opening roll width is very time consuming and dependent for quality on the individual maintenance person.

The patent DE-A 37 30 296 discloses an opening roll in which the tooth-set carrier is designed in the shape of a ring and is secured to the opening roll by means of a holder. The axial width of the opening roll is determined by the width of the tooth-set carrier, since this lies with its front side on the core piece of the opening roll, while on the other side, the cover, that is the holder, supports itself axially on the tooth-set carrier.

From the patent DE-A 195 20 345 is known an opening roll in which the holder and the tooth-set carrier are made integrally as one piece, wherein the tooth-set carrier supports itself axially on the core piece of the opening roll, and thereby the width of the opening roll is determined.

The known opening rolls, in which the tooth-set is changeable, have the disadvantage that either the installation of the opening roll is time and money consuming and the width of the opening roll must be reset anew every time, or that the tooth-set carriers, since they determine the width of the opening rolls, must be produced with great precision and thus expensively. Never-the-less, the problem arises in these embodiments that the width of the opening roll, in spite of more exact manufacture, is still not precisely determined, since the tooth-set, following manufacture, in many instances must be coated, the result being that by material accumulation the width of said tooth-set when so coated varies from that before coating. Thus, the width of the opening roll varies, even with the most exact manufacturing procedures.

OBJECTS AND SUMMARY OF THE INVENTION

One purpose of the present invention is to propose an opening roll which avoids the deficiencies of the present state of the technology and which can be equipped with differently shaped, coated, and untreated tooth-set carriers. Additional objects and advantages of the invention will be set forth in part in the following description, or may be obvious from the description, or may be learned through practice of the invention.

In accordance with the objects of the invention, the core piece possesses an axial detent for the holder, the axial width of the opening roll thus defines itself independently from that of the tooth-set carrier. The width of the tooth-set carrier plays no role then, being indifferent as to whether a tooth-set carrier is coated or not. In particular, different coatings, or different base materials out of which the tooth-set carrier may be made, have no influence on the final dimensioning of the opening roll. The achievement is made at the same time that the installation of the opening roll, that is, not only the first installation, but also replacement after exchange of the tooth-set, is substantially simplified, since no measurements must be undertaken because the correct position of the holder is automatically established. Influence on the width of the opening roll by the securement of the holder by means of axial working screws is no longer important. It is also unimportant what axial force the screws bring to bear on the opening roll. The same benefit arises upon the advantageous formation of the opening roll, in which the holder is built as one piece with the tooth-set carrier.

In a further advantageous embodiment of the invention, the core piece and/or the holder possess a flange, into which the tooth-set carrier radially penetrates. This allows the parting plane between the flange and the tooth-set carrier to be designed as the outer surface of a cylinder, whereby the danger is minimized that fibers agglomerate in the opening between flange and tooth-set carrier.

In a particularly good embodiment, the flange possesses additionally a ring shaped, axial groove, with which it is simultaneously possible to guide the tooth-set carrier radially either on its outer or inner diameter.

The radial placement guidance of the tooth-set carrier by means of the outside diameter of its side provides, besides the usual required guidance, a minimal opening between the flange and the tooth-set carrier. Thereby, flange and tooth-set carrier lie practically against one another without play. This further restricts the infiltration of fibers.

It is especially advantageous if the tooth-set carrier possesses at least on one of its sides an increase of its diameter, with which said carrier can interact with the flange. By this, it is achieved that the parting plane between the tooth-set carrier and the flange then extends radially outwardly away from the outer surface where less opportunity is given for fibers to collect, assuring that set up of fibers in the opening between the tooth-set carrier and the flange is prevented. It is also of advantage if a circumferential groove is machined into the outer side of the tooth-set carrier from the teeth all the way to the flange, which groove lies radially deeper than the outer surface of the tooth-set carrier, whereby the parting plane between the tooth-set carrier and the flange extend radially outward, thus away from the said outer surface. Especially in combination with a diameter increase of the side of the tooth-set holder, it is advantageously achieved that the opening between said tooth-set holder and the flange is extended radially outward where fewer fibers collect.

Particularly favorable is an embodiment with a groove on the tooth-set carrier in which the teeth are made by grinding from solid material. By means of the manufacturing process, an increase in the diameter at the side of the tooth-set carrier is only possible under certain conditions. By means of the embodiment with a groove, however, even in this case the parting plane between the exposed surface of the tooth-set carrier can be brought radially outward, so that advantageously even in this design, the accumulation of fibers in the tooth-set carrier can be avoided.

Another favorable arrangement is the construction of the tooth-set carrier as a ring, since this enables a much simpler exchange of the tooth-set of the opening roll. In doing this, it will be advantageous to design the axial extension of the sides of the rings in a "right-way-only" manner, whereby the maintenance person, upon exchange, receives an indication as to how the ring is to be correctly mounted on the opening roll.

This can also be advantageously attained in that the inner and/or outer diameter of the rings close to the side can be made differently. Then, in connection with the determining of the diameter of the flange, that is to say, the groove of the flange of the opening roll, a faulty mounting can be more surely prevented.

The tooth-set carrier can advantageously be constructed as a steel ring, since this design is favorable in cost, durable, and in multiple ways workable and installable. In doing this, advantage would lie in the steel ring being also shaped in one piece with a tooth-set which could be constructed favorably by grinding in grooves axially and radially in the circumferential direction.

In another favored arrangement of the invention, the tooth-set carrier is a ring, which is produced by a pressure casting method. Thereby, what it achieved, is that the ring is economical and can be produced in large piece numbers. For this method, the ring would be advantageously made of an aluminum alloy.

A particularly advantageous securement of the tooth-set carrier, when this is built separate from the holder, is done in accord with the invention with a flexible element which is set radially on the inside diameter of the tooth-set carrier for the affixing of said carrier. Advantageously, for this purpose, said element acts against the holder with an appropriate force, which the deformation of the flexible element engenders. Favorably, the holder possesses a projection running in an axial direction, which, when viewed from the axial direction, exhibits an inclined plane surface. Upon the mounting thereof, that is upon axial placement in the direction of the core piece, the flexible element is radially extended and pressed against the inner contour of the tooth-set carrier. By this means, the said carrier is securely affixed by a forced closure.

In further especially advantageous embodiments of the invention, the opening roll possesses a core piece, which is not only provided with a fastening means for a one-piece holder incorporating the tooth-set carrier, but also a fastening means for the securement of the tooth-set carrier when this is designed as a ring.

It is favorably achieved thereby, that with only one integral core piece and one tooth-set carrier, which is made ring shaped, this can be attached to the same core piece as can those which are made as one piece units. This is particularly valuable in that many variants of tooth-set carriers can be affixed to the same core piece, whereby an especially user-friendly, multiple sided, and economical separating roll can be produced, which, in exchange operations, can be provided with practically all possible tooth-sets.

In accord with a further advantageous, inventive embodiment, a generic opening roll for an open end spinning apparatus is provided wherein the core piece possesses one or more openings which extend from the front side to the interior of the said core piece. Further, the core piece has a boring in which a bearing sleeve for the support of the separating shaft is located and the said boring diametrically enlarges itself in the interior of the core piece extending axially into the opening thereof. This creates a communicating connection therein for the purpose of cleaning the interior. Thus, contamination in the openings can be removed by the blowing in of compressed air. In this way, impurities which penetrate into the openings of the core piece, the bearing sleeve, and on into the interior of the core piece can thus advantageously be removed in a simple manner. Following the release of the tooth-set carrier, the openings are accessible and dirt accumulations can be easily removed. Particularly favorable is the addition of several openings equally distributed about the turning axis of the opening roll. By means of the advantageous (especially for contamination) communicating connection between the interior and the openings, assurance is given that contamination, for instance agglomerated fibers, can be simply and positively removed.

Further advantageous embodiments of the invention are given by the subordinate claims as well as the description and the drawings which present the invention. In the following, with the aid of the drawings, example embodiments will be described.

DETAILED DESCRIPTION OF THE PREFERRED EMBODIMENTS

Figure 1:
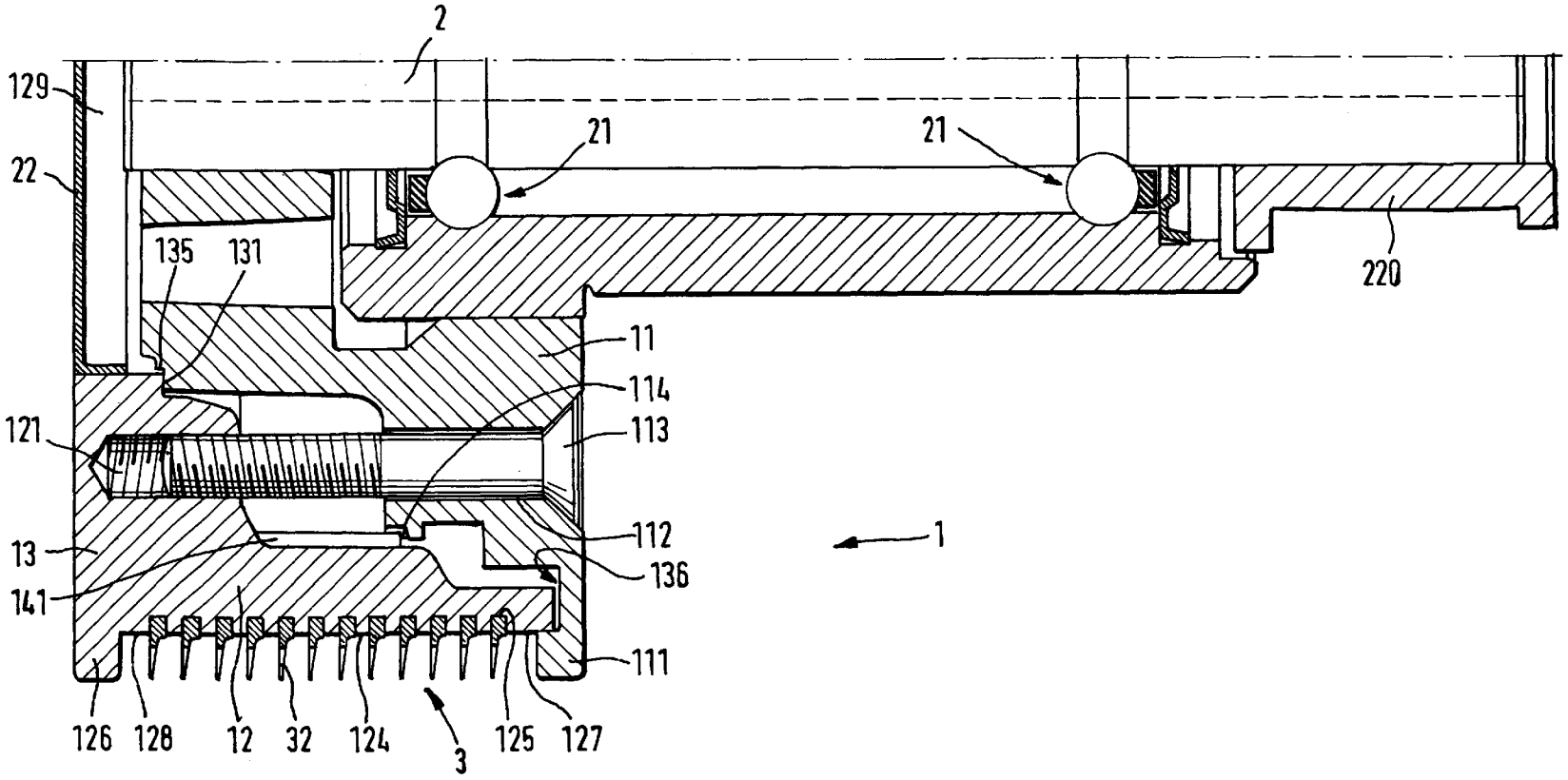
FIG. 1 is a partial sectional presentation of an opening roll in accord with the invention in which the holder and the tooth-set carrier are constructed in one piece.

Reference will now be made in detail to the presently preferred embodiments of the invention, one or more examples of which are illustrated in the drawings. Each example is provided by way of explanation of the invention, and not as a limitation of the invention. For example, features illustrated or described as part of one embodiment can be used with another embodiment to yield still a third embodiment. It is intended that the present invention cover such modifications and variations as come within the scope and spirit of the invention.

The opening roll 1, in accord with the invention, possesses a core piece 11 which fastens said roll on a shaft 2. In this, the core piece 11 is affixed to the shaft 2 by a press fit. The shaft 2 is rotatably confined in bearings 21. The bearing 21 runs in a bearing sleeve (210), which extends by means of the boring 70 into the interior of the core piece 11 and forms an intervening space 71 therewith (See FIG. 4). For the drive of the opening roll 1, the shaft 2 is equipped with a sheave 220 which, together with the shaft 2, is set into rotary motion by means of a drive belt (the belt is not shown). The opening roll 1 exhibits a tooth-set carrier 12, which is coordinated with the core piece. In the embodiment shown in FIG. 1, the tooth-set carrier 12 is made as one piece with the holder 13. By means of the flange 111, the tooth-set carrier 12 is caused to rotate. The holder 13 and the core piece 11 are provided with appropriate fastening means 112, 121, with the help of which the tooth-set carrier 12, the holder 13, and the core piece 11 are affixed to one another. The fastening means 121 of the holder 13 is designed as a threaded boring into which a screw 113 is threadedly inserted in the assembled condition of the holder 13. The opening roll 1 possesses three fastening means 121, 112 axially parallel and disposed at equal angular circular locations.

The fastening means 112 of the core piece 11 is constructed as a boring, through which a screw 113 passes until it is within the fastening means 121 of the holder 13.

In a known manner, a spiral formed groove 125 is machined into the exposed surface 124 of the tooth-set holder 12. In said groove 125, a tooth-set wire is run which carries the teeth of the tooth-set 3 of the opening roll 1. The tooth-set 3 of the separating roll 1 is so constructed that the tooth-set carrier 12 in the area of the flange 111 has a side surface 127, since the tooth-set does not extend so far as the flange 111. On the corresponding side 128, the exposed surface of the tooth-set carrier runs without interruption into the flange 126, since the tooth-set carrier 12 and the holder 13 are of one piece.

The holder 13 possesses in its center area a recess 129 which is closed with a cover 22. The recess 129 is advantageous when the tooth-set is to be coated. Then, several holders 13 with their tooth-set carriers 12 can be picked up by a hook through the opening 129 with the help of which they can be hung in a known procedure in a coating bath. After the coating, the cover 22 can be replaced and closes the opening 129. As a rule, the cover 22 need not be removed again from the tooth-set carrier 12.

For the mounting of the tooth-set carrier 12 by means of the holder 13 on the core piece 11, the said holder and core piece have a coordinating apparatus for an aligned positioning of the fastening means 121 of said holder 13 to its corresponding fastening means 112 of the core piece 11. On the tooth-set carrier 12 or the holder 13 are, for this purpose, one or several radial cross pins 141 which operate in conjunction with detents 114. In a circumferential zone, the core piece 11 has a recess 115, on the one side of which a detent 131 is installed. Upon axially pushing the holder 13 onto the core piece 11, the cross pin 141 protrudes into the said recess 115 which is placed in an axial direction thereto. In order to find the exact alignment of the fastening means 112 and 121 in respect to one another, the tooth-set carrier is rotated until the cross pin 141 strikes the detent 114. Striking the detent can only occur in a rotational direction. Upon turning the other way, the cross pin 141 slides in an inclined plane 116 which acts in an axial direction all along the recess 115. This pushes the holder 13 in a direction away from the core piece 11, so that any mounting of the holder 13 is made impossible (see FIG. 2 and 3).

So that the turning in the proper direction does not continue too far until the detent 114 is found, the opening roll 1, in particular its core piece 11, possesses several detents 114 disposed circumferentially at equal spacing and the tooth-set carrier has advantageously a corresponding plurality of cross pins 141. It is particularly favorable to have at any given time three cross pins 141 and three detents 114. Obviously, the core piece 11 can be outfitted with cross pieces and the holder 13 with detents. A similarly operating embodiment is made manifest by the patent DE-A 195 20 345. In this case, the inclined surface lies in a radial direction, so that clamping occurs upon turning the holder in the wrong direction. An advantageous axial removal of the holder from the core piece does not happen.

In accord with the invention, the core piece 11 is provided with a stop, such as detent 131, upon which the holder 13 rests axially. Thereby, the axial position of the tooth-set carrier 12 is determined independently of the axial extension of core piece 11. Between the flange 111 and the tooth-set carrier 12, is provided an axial play space. At this place, the tooth-set carrier 13 does not need to be manufactured with close tolerances, since the positioning of the tooth-set carrier is effected by means of the detent 131 in relation to the holder 13. This is independent thereof as to whether the tooth-set carrier 12 is coated or whether the holder 13 and the tooth-set carrier 12 are made as one piece (see FIG. 2). The width of the opening roll 1 is thus determined only by the core piece 11 and the holder 13. It is particularly advantageous, as shown in FIG. 1, to make the detent 131 in such a manner that it also forms a radial guide 135 for the holder 13. The radial guide 135 operates advantageously with the surface formed by the opening 129.

Figure 2:
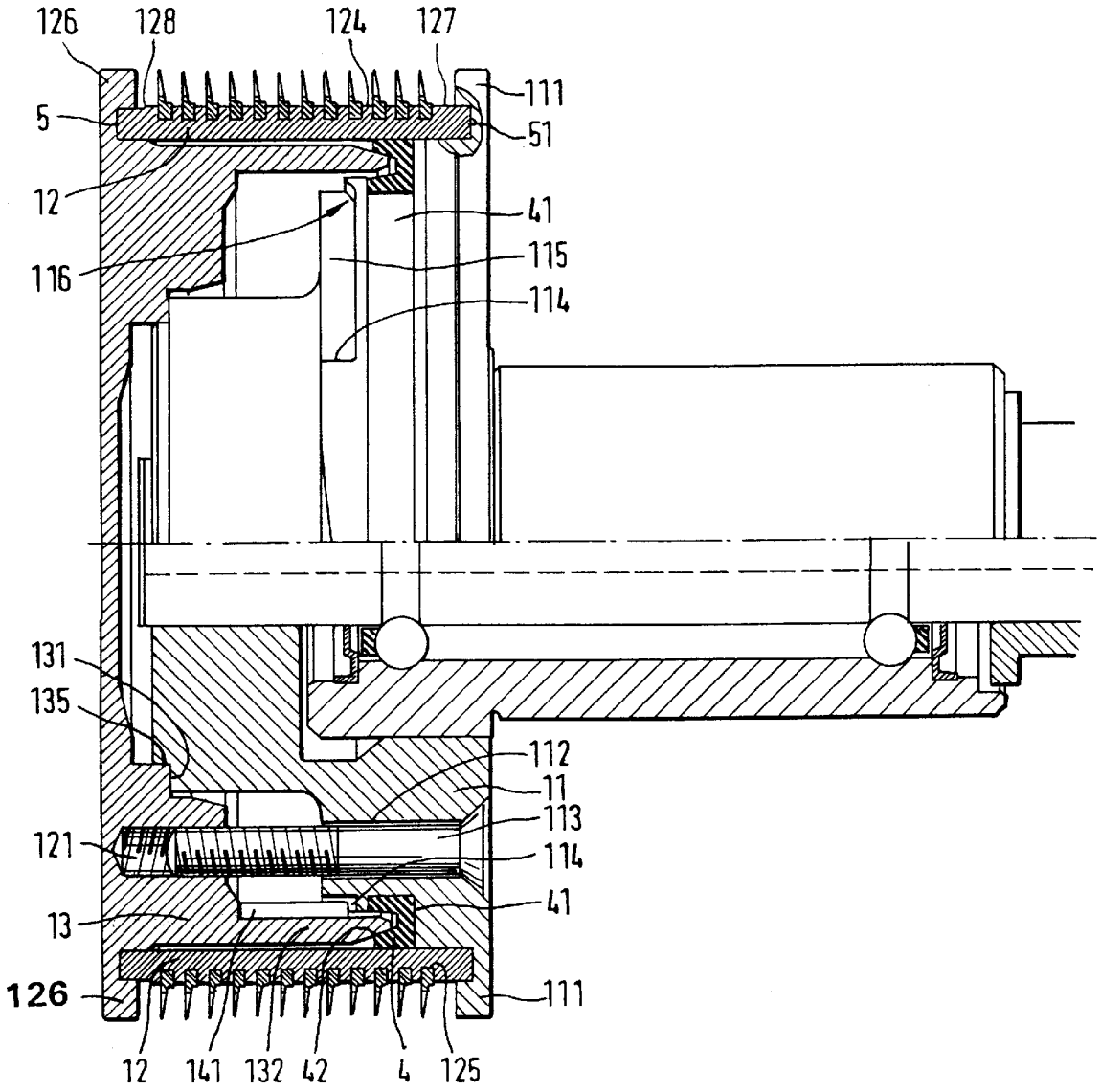
FIG. 2 is a partial sectional view of an opening roll formed in accord with the invention in three parts.

Another embodiment of the opening roll 1 is shown in FIG. 2. Holder 13 and tooth-set carrier 12 form two separate components, which, with the core piece 11, make the opening roll 1. Screws 113 operate in conjunction with the fastening means 112 of the core piece 11 and with 121 of the holder 13. Upon the detent 131 of the core piece 11, the holder 13 strikes axially in such a manner, that the width of the opening roll 1 is determined independently of the axial extension of the tooth-set carrier 12. By means of the radial guide 135, the holder 13 is centered.

The tooth-set carrier 12 in the presently discussed embodiment, is designed as the tooth-set ring which possesses a spiral shaped groove 125 within which, in a conventional manner, a tooth-set wire is laid. The tooth-set carrier 12 is allowed play against flange 111 of the core piece 11 and flange 126 of the holder. Thereby, its axial extension has no influence on the width of the opening roll 1. In the present embodiment, the ring of the tooth-set carrier 12 is centered radially by its inside diameter on the core piece 11.

The ring shaped tooth-set carrier 12 (ring) is held in place and especially secured against slip rotation by means of a clamping element 4 which expands itself axially when the holder 13 is mounted and lies against the inner circumference of the tooth-set ring. The ring shaped clamping element 4, which is made of a flexible material, is inserted into a ring shaped recess 41 of the core piece 11. The clamping element 4 possesses an inclined side 42, which operates together with projections 132 of the holder. Upon the installation of the holder 13, the said projections 132 penetrate into the clamping element 4 in such a manner that it is expanded radially and lies against the inner circumference of the tooth-set ring 12, thus fixing ring 12 in relation to the core piece 11 and further in such a way that a slip rotation of the tooth-set ring 12 is prevented. The projections 132 have even a beveling for this purpose, so that they can more easily press into the clamping element. These can also be so formed that they are not comprised of several single projections, but are connected with one another in a circumferential manner, so that they form a cup shaped, continuous rim on the holder 13.

Thus, the fastening means 112 serves the ring shaped recess 41 for the purpose of binding together the core piece 11 of the opening roll 1 with the exchangeable tooth-set carrier 12. The core piece 11 possesses also favorably, fastening means 112 (which is designed as a boring) and a further fastener 41 (designed as a recess), so that with the same core piece 11 can work together with either a ring shaped tooth-set carrier 12 or a tooth-set carrier built integrally as one piece with the holder 13. Should the core piece be changed over to work in conjunction with a tooth-set ring, this requires only the insertion of a clamping element 4 to be inserted into the recess 41.

The opening roll 1 possesses thus a multifaceted core piece 11 which can accept a multiplicity of different tooth-set carriers by means of differently functioning fastening devices. Besides the axial acting fastening means 112 and 121, the core piece 11 has additionally an independently operating fastening means, the recess 41.

The tooth-set carrier 12 of FIG. 2 exhibits in the area of its side 128, which works in conjunction with the flange 126 of the holder 13, a smaller outside diameter than it has in the area of the flange 111 of the core piece 11. Correspondingly, the groove of the flange 126 is shaped differently than the groove 51 of the flange 111. The transition of the outside diameters of the tooth-set carrier 12 is brought about smoothly without steps from the tooth-set 3 to the flange 126. It could be done very easily by stages. The smaller outside diameter of the side 128 of the tooth-set carrier 12 has, when this is fashioned as a ring, the advantage that upon the installation of the tooth-set carrier 12, this cannot be incorrectly fastened onto the opening roll 1. Particularly, when the diameter change in the area of the flange 126 of the holder 13 takes place, the installation becomes very simple. In the case of a new mounting of the tooth-set ring, this is done in such a manner that the holder 13 with its flat front side is laid on a support base, and then the tooth-set carrier 12 is inserted into the groove 5 of said holder 13. This is possible only in the correct arrangement, since groove 5 of the holder 13 is so shaped, that only the smaller outside diameter of the tooth-set ring allows a mounting of the tooth-set carrier 12 on the holder 13. An incorrect insertion of the tooth-set carrier 12 would then be immediately noticed, even before the core piece 11, which is much more unwieldy, is installed. Obviously, the same result can be reached wherein, close to the flange 126, the outside diameter of the side 128 of the tooth-set carrier 12 is not diminished, but instead the other side 127 near flange 111 has a greater outside diameter. The flange 111, which encompasses the exposed surface 124 in the area of the larger diameter, possesses in this case a correspondingly formed groove 51.

During the operation of the opening roll 1, bunched fibers enter into the tooth-set 3 in a conventional manner and are then separated into individual fibers by the teeth 32 of the tooth-set wire.

The fibers are suspended in the air brought into motion by the rotation of the opening roll 1 in the region of the tooth-set 3 between the teeth before they exit from the separation roll housing at a specific point. These entrained individual fibers can accumulate and set up solidly in fissures and surface irregularities of the said opening roll 1. These packed fibers, after a short time, leave their said locations and then become fiber agglomerations which make themselves noticeable as faults in the eventual threads. In order to prevent that the fibers become trapped in the opening between the core piece 11 and the tooth-set carrier 12, provision can be made that the outer surface 124 in the area between the tooth-set 3 and the flange 111 possesses a circumferential groove 6. This allows that within the said groove 6, the outer surface 124 is depressed in the direction of the rotational axis of the opening roll 1, while the opening between the tooth-set carrier 12 and flange 111 is arranged in an area of the normal diameter of said outer surface. This is presented in FIG. 3. Thus, the opening between tooth-set carrier 12 and the holder 13 is thereby less endangered from the trapping of fibers. The same effect may be achieved in such a way that, instead of a circumferential groove 6, the side of the tooth-set carrier 12 can be increased in diameter where it fits into the flange.

Figure 3:
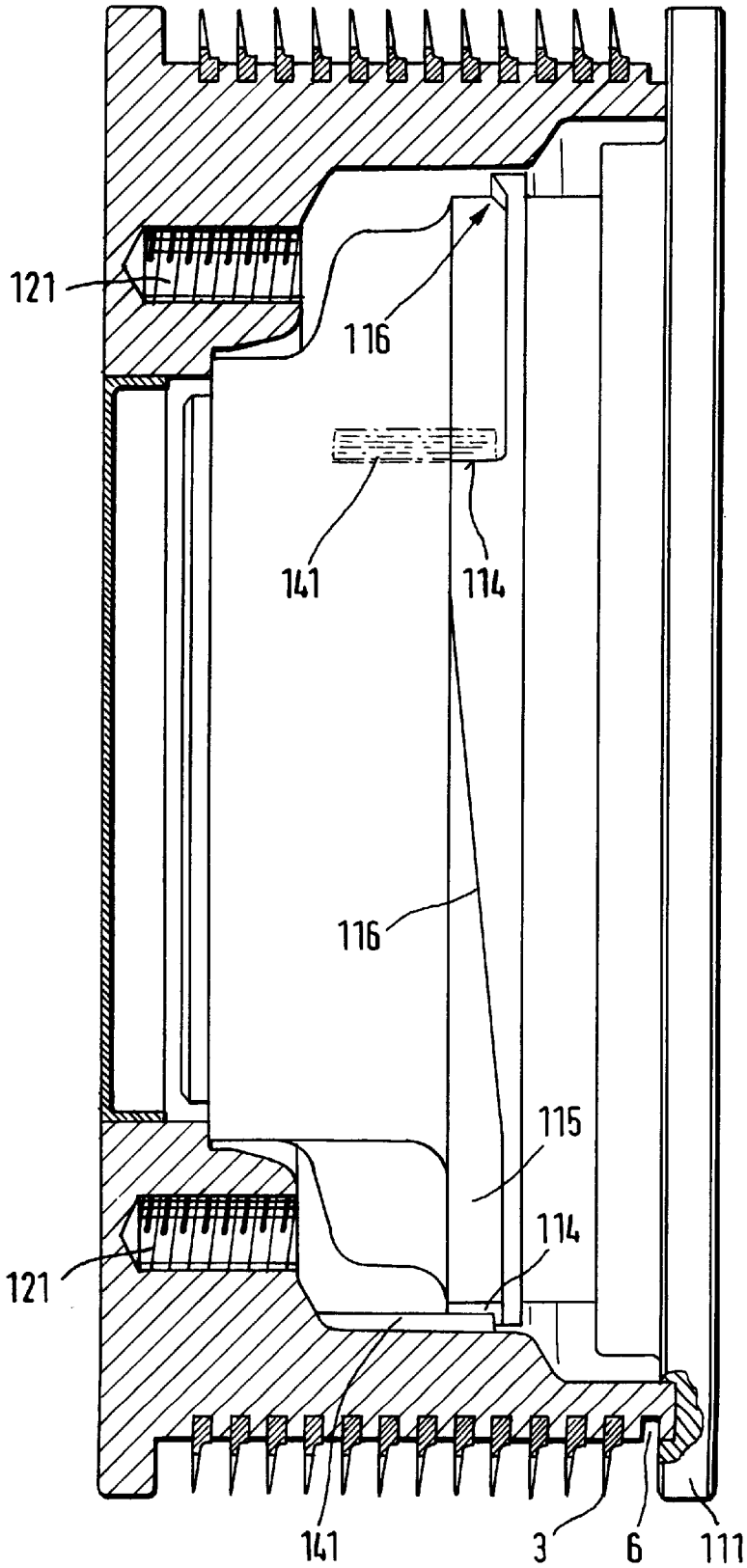
FIG. 3 is a side view of a core piece of an opening roll in accord with the invention with the tooth-set carrier shown in section.

FIG. 3 shows additionally in an enlarged presentation the cross pin 141 on the holder 13 in the position where it lies against the detent 114 of the core piece 11. Since the holder 13 exhibits three cross pins 141, the core piece accordingly possesses three detents 114. The detent 114 shown in the upper half of the FIG. 3 has a such a cross pin 141, which is shown by dotted lines since it would not otherwise be recognizable in the format of FIG. 3. Three of these cross pins 141 are installed in the inner circumference of the holder 13. By the manual rotation of the holder 13 with its cross pins 141 away from the detents 114, each cross pin 141 slides on its respective inclined plane surface 116 which is sloped in relation to the longitudinal axis of the shaft. By this arrangement, the holder 13 is distanced from the core piece 11 in an axial direction. This sends a signal to the person doing the installation of a new tooth-set carrier 12, that the turning direction of the holder 13 in relation to the core piece 11 is incorrect.

When the rotation direction is correct, then the cross pin 141 slides along the inclined surface 116 and can, upon further turning, impact against the detent 114. As soon as the detent 114 comes into contact with the cross pin 141, the fastening means 112 and 121 find themselves aligned with one another, so that, for instance, the screw 113 can be inserted into the fastening means (see FIG. 1). The advantageous formation of the opening roll 1 is independent of other features of said roll.

Figure 4:
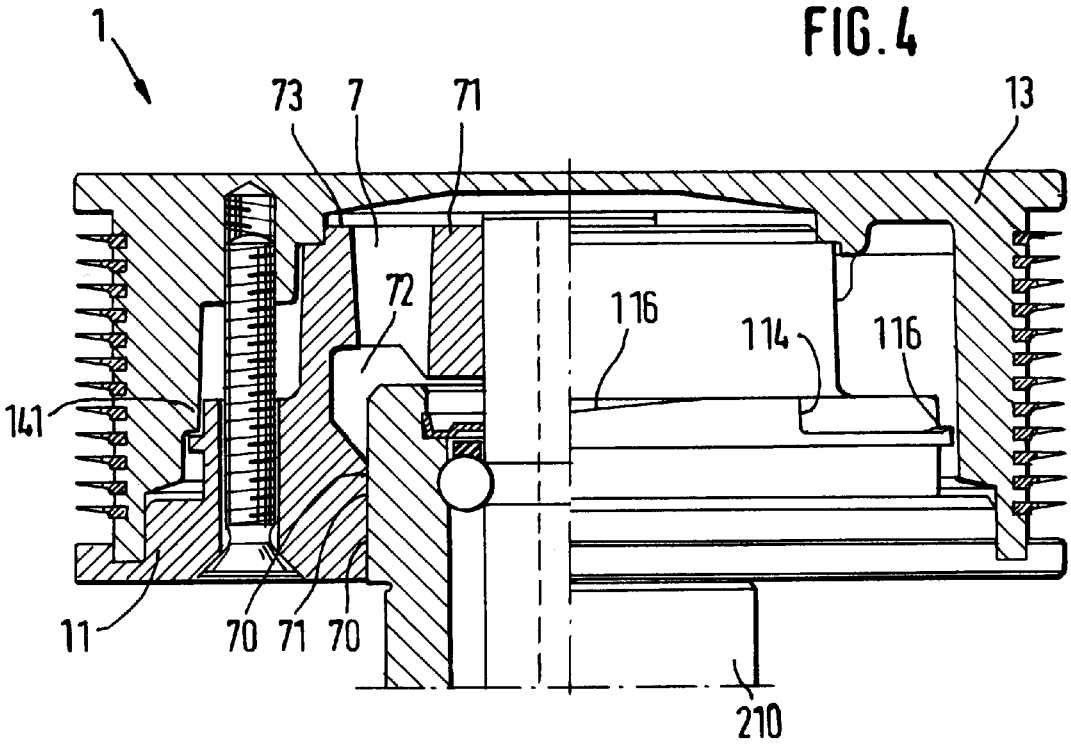
FIG. 4 is a sectional view of an opening roll in accord with the invention shown in two part embodiment with axial openings in the front side of the core piece.

FIG. 4 depicts a particularly advantageously designed separation roll 1 with the core piece 11. The holder 13 is constructed as one piece with the tooth-set carrier 12. In the axial direction, the interior space 72 links up with the opening 71 between the core piece 11 and the bearing sleeve 210, which is provided for the acceptance of contamination which penetrates through the opening 71. The boring 70 forms, through the increasing of its diameter in connection with opening 71, the inner space 72. The interior space 72 is connected with the opening 7. The transition between the interior space 72 and the opening 7 forms such a large annular opening, that particles of contamination certainly come out of the interior space 72 into the opening 7. By removing the holder 13, the openings arranged in the front side of the core piece 11 are exposed. In the embodiment shown in FIG. 4, there are six openings 7 provided (see also FIG. 5), which communicate with one another through the interior space 72. In principle, even one opening would suffice, if it were large enough and was designed for the entry of, for instance, cleaning means or compressed air and at the same time suitable for the removal of contamination. The core piece 11 is advantageously made as a precision pressure casting, which means comprised of aluminum or magnesium, so that the openings can be formed even during the casting. In the present case, with connection between the interior space 72 and the opening 7 is achieved by a diametrical increase in the boring. This is also possible, through a diminution of the outside diameter of the bearing sleeve 210 in the transition zone between interior space 72 and the opening 7. It is important for the invention, that the interior space 72 be connected with the opening 7 by a sufficiently large free space.

Figure 5:
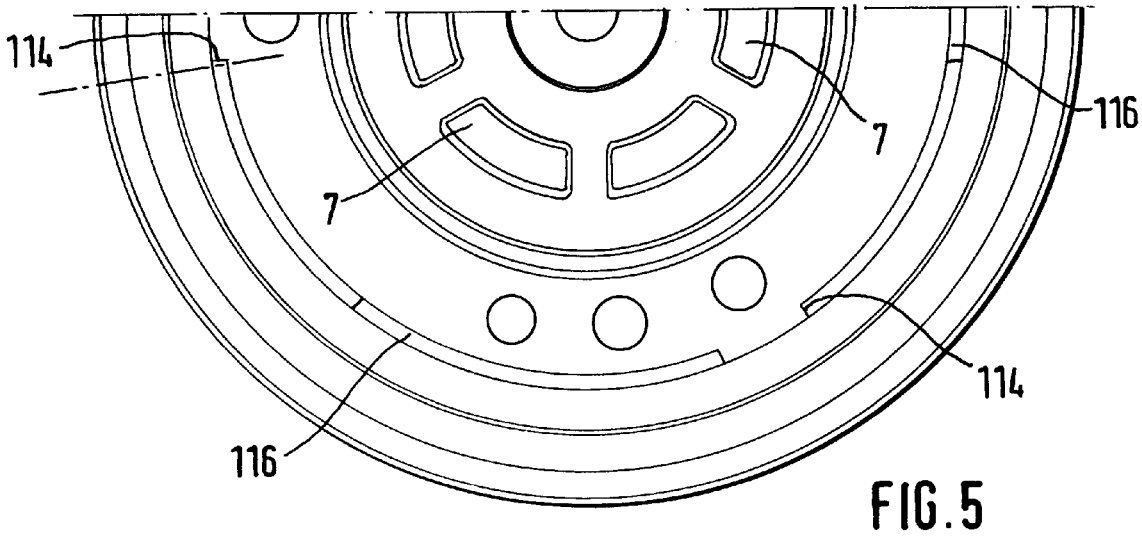
FIG. 5 is a partial plan view of the core piece of FIG. 4.

The core piece 11 is provided with three detents 114. Cross pin 141 of the holder 13 is shown in FIG. 4 in a right angle section. The section course is made plain by FIG. 5 by means of the dotted line. The holder 13 is arrested by its cross pin 141 against the detent 114, again see FIG. 5. Thus, the correct position of the holder 13 is made recognizable for the mounting operation. The detent of the holder 13 on the right side of the presentation of FIG. 4 is not visible. FIG. 4 shows in the right half of the presentation of the core piece 11, the start of the inclined plane surface 116, which moves the holder 13 in a direction away from the core piece 11 when the holder 13 is turned in the wrong direction. FIG. 5 shows two of the visible inclined surfaces 116. The core piece 11 is provided with three detents 114, which are equally circumferentially spaced. Accordingly, the holder 13 possesses three cross pins 141.

Claimed is:

1. A multi-component opening roll for an open end spinning apparatus, comprising:

a core piece;

a replaceable tooth set carrier and a holder for said tooth set carrier, said holder mountable onto said core piece;

an axial stop defined on said core piece extending generally radially from said core piece and against which a complimenting surface of said holder lies; and said axial stop defining an axially limiting position of said holder on said core piece such that the axial width of said opening roll is defined by opposite faces of said core piece and said holder without said tooth set carrier being compressed between said core piece and said holder, said axial width thus being constant regardless of axial variations of said tooth set carrier.

2. The opening roll as in claim 1, wherein said holder and said tooth set carrier are formed as a unitary component.

3. The opening roll as in claim 1, further comprising a flange defined on said core piece and an oppositely facing flange defined on said holder, said tooth set carrier axially interposed between said flanges, said flanges defining said opposite faces.

4. The opening roll as in claim 3, wherein each of said flanges comprises a circumferential groove defined therein, said tooth set carrier comprising axial ends disposed within said grooves.

5. The opening roll as in claim 4, wherein said axial ends have different widths and said grooves have correspondingly sized widths such that said tooth set carrier can only be received in said grooves in one orientation of said tooth set carrier.

6. The opening roll as in claim 1, wherein said tooth set carrier comprises a cylindrical ring member defined by axially extending sides of a defined axial width.

7. The opening roll as in claim 6, wherein said axially extending sides have different axial widths.

8. The opening roll as in claim 6, wherein said axially extending sides have different axial width diameters.

9. The opening roll as in claim 6, further comprising a shoulder defined in an axial width of at least one of said sides.

10. The opening roll as in claim 1, further comprising a flange defined on said core piece, said tooth set carrier and said holder formed as a single component and defining an oppositely facing flange.

11. The opening roll as in claim 1, wherein said holder further comprises a fastening mechanism to attach said holder to said core piece.

12. The opening roll as in claim 1, wherein said tooth set carrier comprises a steel cylindrical ring member defined by sides of a defined axial width, said ring member having a spiral groove defined in an outer circumference thereof between said sides.

13. The opening roll as in claim 1, further comprising a flange defined on said core piece and an oppositely facing flange defined on said holder, said tooth set carrier axially interposed between said flanges, at least one of said flanges defining a radial centering to center said tooth carrier on said core piece.

14. The opening roll as in claim 1, further comprising a flange defined on said core piece and an oppositely facing flange defined on said holder, said tooth set carrier axially interposed between said flanges with axial play therebetween.

15. The opening roll as in claim 1, further comprising a flexible element disposed relative to said holder to connect said tooth set carrier to said holder, said flexible element acting upon an inner circumferential surface of said tooth set carrier.

16. The opening roll as in claim 15, wherein said holder comprises an axially extending projection having an inclined surface defined thereon, said inclined surface acting upon said flexible element to force said flexible element radially outward against said tooth set carrier.

17. The opening roll as in claim 1, wherein said holder further comprises a first fastening device to secure said holder to said core piece, and a second fastening device to secure said tooth set carrier to said holder.

18. The opening roll as in claim 17, further a fastening device on said core piece cooperating with said first fastening device, and a position alignment device to prevent misalignment between said first fastening device and said core piece fastening device.

19. The opening roll as in claim 17, further comprising an affixing device operationally engaging with said core piece, said holder, and said tooth set carrier to affix said tooth set carrier to said holder.

20. The opening roll as in claim 1, wherein said core piece further comprises at least one opening disposed through a front side thereof into an interior of said core piece defined by a boring therein, said opening providing access to said interior for cleaning of said opening roll.

* * * * *